US010847303B2

(12) United States Patent
Kim et al.

(10) Patent No.: US 10,847,303 B2
(45) **Date of Patent: *Nov. 24, 2020**

(54) COIL COMPONENT

(71) Applicant: SAMSUNG ELECTRO-MECHANICS CO., LTD., Suwon-Si (KR)

(72) Inventors: Jae Hun Kim, Suwon-Si (KR); Hwa Sung Hwang, Suwon-Si (KR); Young Ku Lyu, Suwon-Si (KR); Boum Seock Kim, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 159 days.

This patent is subject to a terminal disclaimer.

(21) Appl. No.: 16/101,862

(22) Filed: Aug. 13, 2018

(65) Prior Publication Data

US 2018/0350508 A1 Dec. 6, 2018

Related U.S. Application Data

(63) Continuation of application No. 15/229,329, filed on Aug. 5, 2016, now Pat. No. 10,074,473.

(30) Foreign Application Priority Data

Dec. 18, 2015 (KR) ..... 10-2015-0181731

(51) Int. Cl.
*H01F 27/28* (2006.01)
*H01F 17/00* (2006.01)
(Continued)

(52) U.S. Cl.
CPC ..... *H01F 27/2804* (2013.01); *H01F 17/0013* (2013.01); *H01F 17/04* (2013.01);
(Continued)

(58) Field of Classification Search
CPC ... H01F 27/2804; H01F 27/022; H01F 27/255
(Continued)

(56) References Cited

U.S. PATENT DOCUMENTS 2,948,051 A * 8/1960 Eisler ..... H01F 17/0006 174/261
6,338,936 B1 * 1/2002 Ichikawa ..... G03F 7/0392 430/280.1
(Continued)

FOREIGN PATENT DOCUMENTS

JP 2004-193469 A 7/2004
JP 2004193469 A * 7/2004
(Continued)

OTHER PUBLICATIONS

Non-Final Office Action issued in related parent U.S. Appl. No. 15/229,329, dated Oct. 5, 2017.
(Continued)

*Primary Examiner* — Tszfung J Chan
(74) *Attorney, Agent, or Firm* — Morgan, Lewis & Bockius LLP

(57) ABSTRACT

A coil component includes a body in which a coil portion is embedded. The coil portion includes a support member; first insulators formed on first and second main surfaces of the support member, respectively, and having an opening having a planar coil shape; coils filling the openings; and second insulators covering the coils.

14 Claims, 7 Drawing Sheets

(51) Int. Cl.

| | |
|---|---|
| ***H01F 17/04*** | (2006.01) |
| ***H01F 41/12*** | (2006.01) |
| ***H01F 27/255*** | (2006.01) |
| ***H01F 41/02*** | (2006.01) |
| ***H01F 41/04*** | (2006.01) |

(52) U.S. Cl.
CPC ..... *H01F 27/255* (2013.01); *H01F 41/0233* (2013.01); *H01F 41/041* (2013.01); *H01F 41/122* (2013.01); *H01F 41/125* (2013.01); *H01F 2017/048* (2013.01)

(58) Field of Classification Search
USPC ..... 336/200, 232
See application file for complete search history.

(56) References Cited

U.S. PATENT DOCUMENTS

| | | | | |
|---|---|---|---|---|
| 6,600,404 | B1 * | 7/2003 | Kajino | H01F 5/003 257/531 |
| 2004/0164835 | A1 | 8/2004 | Shoji | |
| 2005/0266342 | A1 * | 12/2005 | Kim | G03F 7/0045 430/270.1 |
| 2006/0097820 | A1 | 5/2006 | Watanabe et al. | |
| 2010/0052838 | A1 * | 3/2010 | Matsuta | H01F 17/0013 336/200 |
| 2012/0286917 | A1 * | 11/2012 | Uchida | H01F 17/0013 336/200 |
| 2013/0249662 | A1 * | 9/2013 | Tonoyama | H01F 27/255 336/200 |
| 2014/0002226 | A1 * | 1/2014 | Moon | H01F 41/125 336/200 |
| 2014/0022041 | A1 | 1/2014 | Park et al. | |
| 2014/0176283 | A1 * | 6/2014 | Yang | H01F 41/046 336/200 |
| 2014/0247102 | A1 * | 9/2014 | Kurobe | H01F 5/003 336/200 |
| 2014/0333404 | A1 * | 11/2014 | Bae | H01F 17/0013 336/192 |
| 2015/0042440 | A1 * | 2/2015 | Tsurumi | H05K 1/165 336/221 |
| 2016/0155556 | A1 * | 6/2016 | Ohkubo | H01F 41/043 336/83 |

FOREIGN PATENT DOCUMENTS

| | | | | | |
|---|---|---|---|---|---|
| JP | 2004-253684 | A | | 9/2004 | |
| JP | 2006-135056 | A | | 5/2006 | |
| JP | 2006-278909 | A | | 10/2006 | |
| JP | 2006278909 | A | * | 10/2006 | |
| JP | 2009-246376 | A | | 10/2009 | |
| JP | 2009246376 | A | * | 10/2009 | |
| JP | 2014229739 | A | * | 12/2014 | |
| JP | 2015032625 | A | * | 2/2015 | H01F 17/0013 |
| KR | 10-2001-0001338 | A | | 1/2001 | |
| KR | 10-0690106 | B1 | | 3/2007 | |
| KR | 10-2014-0011693 | A | | 1/2014 | |
| KR | 10-2014-0137306 | A | | 12/2014 | |
| KR | 10-2015-0071266 | A | | 6/2015 | |

OTHER PUBLICATIONS

Notice of Allowance issued in related parent U.S. Appl. No. 15/229,329, dated May 24, 2018.

* cited by examiner

COIL COMPONENT

CROSS-REFERENCE TO RELATED APPLICATION

This application is a Continuation of U.S. patent application Ser. No. 15/229,329, filed on Aug. 5, 2016, which claims the benefit of priority to Korean Patent Application No. 10-2015-0181731, filed on Dec. 18, 2015 with the Korean Intellectual Property Office, the entirety of which are incorporated herein by reference.

BACKGROUND

The present disclosure relates to a coil component.

An inductor, which is a type of coil electronic component, is a representative passive element configuring an electronic circuit together with a resistor and a capacitor to remove noise therefrom.

Among coil electronic components, a thin film type inductor may be manufactured by forming coils using a plating method, hardening a magnetic powder-resin composite in which magnetic powder and a resin are mixed with each other to manufacture a magnetic body, and then forming external electrodes on external surfaces of the magnetic body.

In accordance with technological developments allowing such elements to be more highly complex, multifunctional and relatively slim, attempts at miniaturizing the above-mentioned thin film type inductor have recently continued. However, in a case in which the thin film type inductor is manufactured to have a small size, since a volume of the magnetic body implementing characteristics of the component is reduced and there is a limit to increasing a line width or a thickness of a coil, deterioration of desired characteristics may occur. Therefore, there is a demand for a solution that may prevent the deterioration of desirable characteristics while advancing the above-mentioned miniaturization trend.

SUMMARY

An aspect of the present disclosure provides a coil component having excellent product characteristics, and a method for manufacturing the same.

An aspect of the present disclosure provides a new structure of a coil component which may be miniaturized and has excellent reliability. According to an aspect of the present disclosure, a coil component includes first insulators formed on at least one surface of a support member and having an opening, coils filling the opening, and second insulators covering the first coils.

According to an exemplary embodiment in the present disclosure, a coil component includes a body in which a coil portion is embedded. The coil portion includes a support member; first insulators formed on first and second main surfaces of the support member, respectively, and having an opening having a planar coil shape; coils filling the opening; and second insulators covering the coils.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
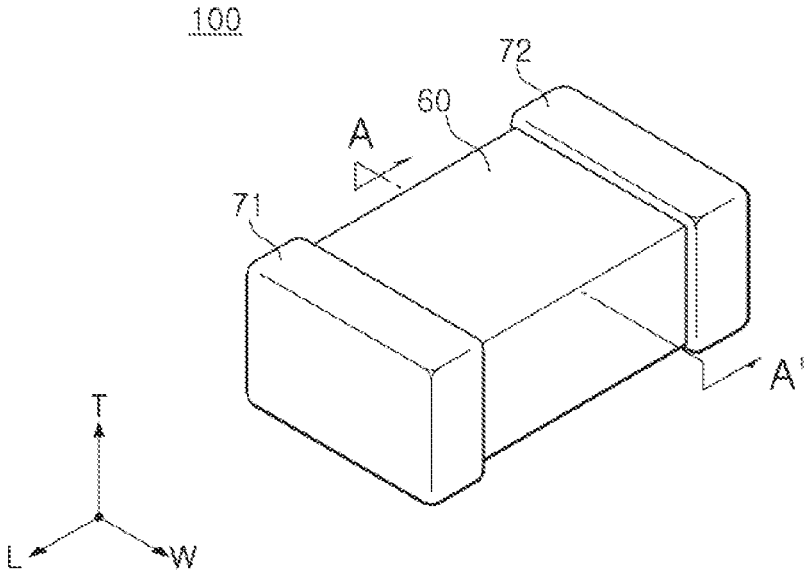
FIG. 1 is a perspective view of a coil component according to an exemplary embodiment in the present disclosure.

Exemplary embodiments of the present disclosure will now be described in detail with reference to the accompanying drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no other elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship relative to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present disclosure. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

Coil Component

Hereinafter, a coil component according to an exemplary embodiment in the present disclosure, particularly, a thin film type inductor will be described. However, the present disclosure is not necessarily limited thereto.

Figure 2:
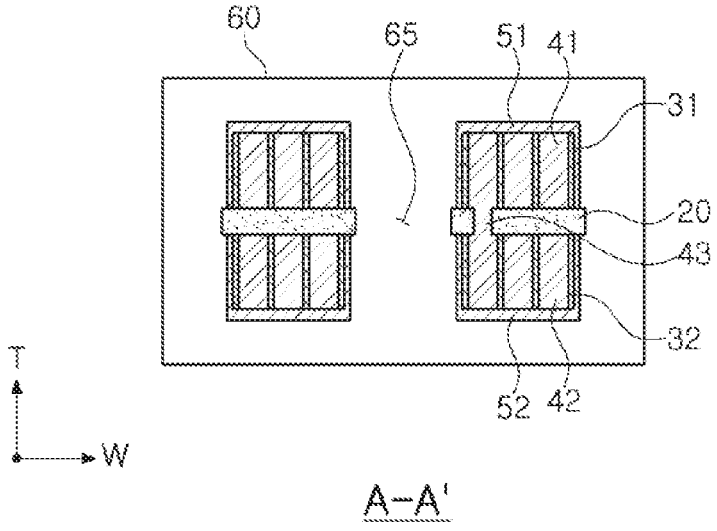
FIG. 2 is a cross-sectional view taken along line A-A' of the coil component of FIG. 1.

FIG. 1 is a perspective view of a coil component according to an exemplary embodiment in the present disclosure and FIG. 2 is a cross-sectional view taken along line A-A' of the coil component of FIG. 1.

As illustrated in FIG. 1, in the following description, a 'length direction' refers to an 'L' direction of FIG. 1, a 'width direction' refers to a 'W' direction of FIG. 1, and a 'thickness direction' refers to a 'T' direction of FIG. 1.

Referring to FIGS. 1 and 2, a coil component 100 according to an exemplary embodiment in the present disclosure may include a body 60 in which one or more coil portions are embedded.

The body 60 may form an external body determining the appearance of the coil component 100, and may be formed in a form in which ferrite powder or metallic magnetic powder exhibiting magnetic characteristics is dispersed in a thermosetting resin such as an epoxy resin, polyimide resin, or the like, but is not necessary limited thereto.

As a detailed exemplary embodiment, the ferrite powder may be one or more selected from the group consisting of a Mn—Zn based ferrite powder, a Ni—Zn based ferrite powder, a Ni—Zn—Cu based ferrite powder, a Mn—Mg based ferrite powder, a Ba based ferrite powder, and a Li based ferrite powder. Further, the metallic magnetic powder may be one or more selected from the group consisting of iron (Fe), silicon (Si), chromium (Cr), aluminum (Al), and nickel (Ni). For example, the metallic magnetic powder may be a Fe—Si—B—Cr based amorphous metal, but is not limited thereto.

Referring to FIG. 2, the coil portions embedded in the body 60 of the coil component according to an exemplary embodiment may include a support member 20, first insulators 31 and 32, coils 41 and 42, and second insulators 51 and 52.

The support member 20 may be, for example, a polypropylene glycol (PPG) substrate, a ferrite substrate, or a metal soft magnetic substrate. A through hole may be formed in a central portion of the support member 20, and the through hole may also be filled with a magnetic material to form a core part 65. As such, since the core part 65 filled with the magnetic material is formed, performance of a thin film type inductor may be further improved.

The first insulators 31 and 32 may be respectively formed on first and second main surfaces of the support member 20, and may have an opening having a planar coil shape. The planar coil shape may be a spiral shape, but is not necessarily limited thereto.

The first insulators 31 and 32 may be formed of a photosensitive material in which a photo acid generator (PAG) and a variety of epoxy based resins are combined, and one or more epoxies may be used.

In a case in which an aspect ratio of the first insulators 31 and 32 is excessively small, capacity may be decreased due to a decrease in an area of a magnetic body, and in a case in which the aspect ratio thereof is excessively large, it may be difficult to form a pattern. Therefore, as a non-limiting exemplary embodiment, the aspect ratio of the first insulators 31 and 32 may be 5:1 to 25:1.

The coils 41 and 42 may fill the respective openings of the planar coil shapes, and may include a metal having excellent electrical conductivity. For example, the coils 41 and 42 may be formed of silver (Ag), palladium (Pd), aluminum (Al), nickel (Ni), titanium (Ti), gold (Au), copper (Cu), or platinum (Pt), or an alloy thereof, but are not necessarily limited thereto.

The coils 41 and 42 respectively formed on the first and second main surfaces of the support member 20 may be electrically connected to each other through a via electrode penetrating through the support member 20.

As an exemplary embodiment of a process for manufacturing the coils 41 and 42 in a thin film shape, an electroplating method may be used. However, the process for forming the coils 41 and is not necessarily limited thereto. For example, other processes which are known in the art may also be used as long as the processes show a similar effect.

According to an exemplary embodiment, the coils 41 and 42 may include seed portions 41*a* and 42*a* formed on the surface of the support member 20, and plating portions 41*b* and 42*b* formed on the seed portions 41*a* and 42*a* to fill the opening.

Further, according to another exemplary embodiment, the coils 41 and 42 may include seed portions 41*a* and 42*a* formed on the surface of the support member 20 and side surfaces of the first insulators 31 and 32, and plating portions 41*b* and 42*b* formed on the seed portions 41*a* and 42*a* to fill the opening.

Direct current resistance Rdc, which is one of the important properties of the inductor, may be decreased as a cross-sectional area of the coil is increased. In addition, inductance, which is another one of the important properties of the inductor, may be increased as an area of a magnetic material through which magnetic flux passes is increased. Therefore, in order to decrease the DC resistance (Rdc) and increase the inductance, there are needs to increase the cross-sectional area of the coil and increase the area of the magnetic material by increasing a line width or a thickness of the coil.

However, there is a predetermined limit to increasing the cross-sectional area of the coil when the coil is formed by the electroplating method.

That is, in a case in which the line width of the coil is intended to be increased, there is a limit on the number of turns of implementable coils, which causes a decrease in an area of the magnetic material. As a result, there is a deterioration in efficiency and a limit to implementing a high capacity product. In a case in which the thickness of the coil is intended to be increased, a short circuit may occur between neighboring coils by an isotropic growth in which a growth of the coil in a thickness direction thereof and a growth of the coil in a width direction thereof are simultaneously performed as plating is performed. As a result, there is a limit to decreasing the DC resistance Rdc.

Therefore, according to the present disclosure, by forming the coils 41 and 42 in the opening subsequently to the first insulators 31 and 32 having the opening of the planar coil shape, the first insulators 31 and 32 may serve as a plating growth guide. As a result, since the shapes of the coils may be easily adjusted and the coil having a high aspect ratio may be implemented, the coil component having excellent product characteristics may be implemented.

In a case in which the line width of the coils 41 and 42 is excessively large, a volume of the magnetic material in the body may be decreased, which may have an adverse effect on the inductance. As a non-limiting exemplary embodiment, an aspect ratio of the coils 41 and 42 may be 3:1 to 9:1.

Furthermore, in a case in which thicknesses of the first insulators 31 and 32 and thicknesses of the coils 41 and 42 are different from each other, a short circuit defect may occur between neighboring coils or capacity may be decreased due to the decrease in the area of the magnetic material. Therefore, as a non-limiting exemplary embodiment, the thicknesses of the first insulators 31 and 32 and the coils 41 and 42 may be the same as each other, or the thicknesses of the first insulators 31 and 32 may be thicker than thicknesses of the coils 41 and 42. Here, the term 'thickness' refers to a length of the first insulators and the coil in a 'T' direction of FIG. 1.

The second insulators 51 and 52 may serve to cover the coils 41 and 42, and secure insulation property between the coils 41 and 42 and the body 60.

The second insulators 51 and 52 may include one or more selected from the group consisting of an epoxy based resin, a polyimide based resin, and a liquid crystalline polymer (LCP) based resin, but are not necessarily limited thereto.

The coil component 100 according to an exemplary embodiment may further include external electrodes 81 and 82 disposed on external surfaces of the magnetic body 60, and electrically connected to the coils 41 and 42.

The external electrodes 81 and 82 may be formed of a metal having excellent electrical conductivity, for example, one of nickel (Ni), copper (Cu), tin (Sn), or silver (Ag), or an alloy thereof.

A plating layer (not illustrated) may be formed on the external electrodes 81 and 82. In this case, the plating layer may include any one or more selected from the group consisting of nickel (Ni), copper (Cu), and tin (Sn), and for example, a nickel (Ni) plating layer and a tin (Sn) plating layer may be sequentially formed.

Method for Manufacturing Coil Component

Hereinafter, an exemplary embodiment of a method for manufacturing a coil component 100 having the structure described above will be described.

FIGS. 3A through 3E are views sequentially illustrating a process of manufacturing a coil component according to an exemplary embodiment in the present disclosure.

Figure 3A:
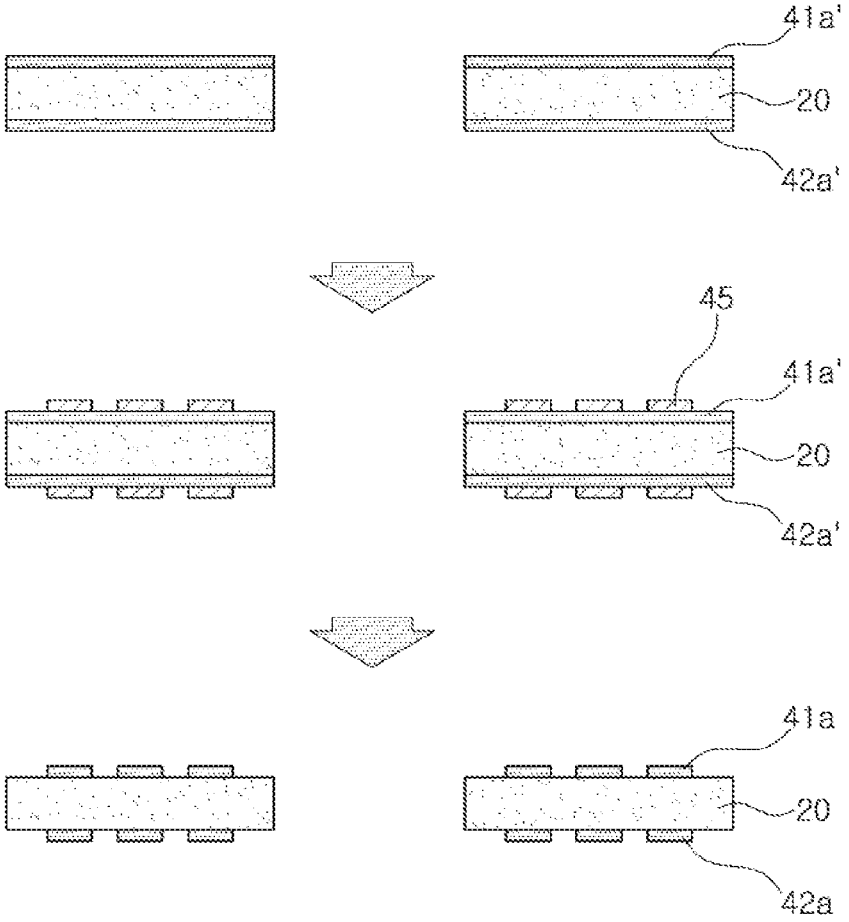
FIGS. 3A through 3E are views sequentially illustrating a process of manufacturing a coil component according to an exemplary embodiment in the present disclosure.

First, referring to FIG. 3A, seed portions 41*a* and 42*a* having a planar coil shape may be formed on first and second main surfaces of a support member 20, respectively. Meanwhile, prior to forming the seed portions 41*a* and 42*a*, a via hole (not illustrated) may be formed in the support member 20. A seed portion (not illustrated) may also formed on a wall surface of the via hole (not illustrated), and the via hole (not illustrated) may be filled with a plating portion (not illustrated). As a result, a via electrode 43 may be formed. However, in order to describe the formation of coils in more detail, the formation of the seed portion on the wall surface of the via hole (not illustrated) and the plating portion (not illustrated) filled in the via hole (not illustrated) will be omitted from the drawings illustrating a process of manufacturing a coil component for convenience.

Further, a through hole for forming a core part 65 may be formed in a central region of the support member 20 using a method such as mechanical drill, laser drill, sand blast, punch processing, or the like, and the through hole may be filled with a magnetic material in a process of stacking, compressing, and curing magnetic sheets to be described below, to thereby form the core part 65.

In the present disclosure, a method for forming the seed portions 41*a* and 42*a* of the planar coil shape is not particularly limited. As a non-limiting exemplary embodiment, the seed portions 41*a* and 42*a* of the planar coil shape may be formed by forming seed layers 41*a*' and 42*a*' on the first and second main surfaces of the support member 20, forming photo resists 45 having an opening on each of the first and second main surfaces of the support member 20 on which the seed layers 41*a*' and 42*a*' are formed, etching portions exposed through the opening, and then delaminating the photo resists.

Figure 3B:
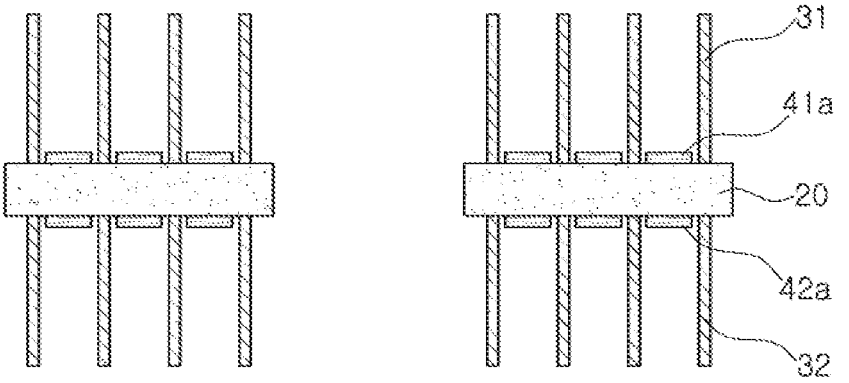

Next, referring to FIG. 3B, first insulators 31 and 32 may be formed on regions except for the regions on which the seed portions 41*a* and 42*a* are formed.

In the present disclosure, a method for forming the first insulators on the regions except for the regions on which the seed portions 41*a* and 42*a* are formed is not particularly limited. As a non-limiting exemplary embodiment, the first insulators may be formed on the regions except for the regions on which the seed portions 41*a* and 42*a* are formed, by compressing insulating sheets on the first and second main surfaces of the support member on which the seed portions 41*a* and 42*a* are formed, and selectively removing only the insulating sheets disposed on the regions on which the seed portions 41*a* and 42*a* are formed, by exposure and development.

Figure 3C:
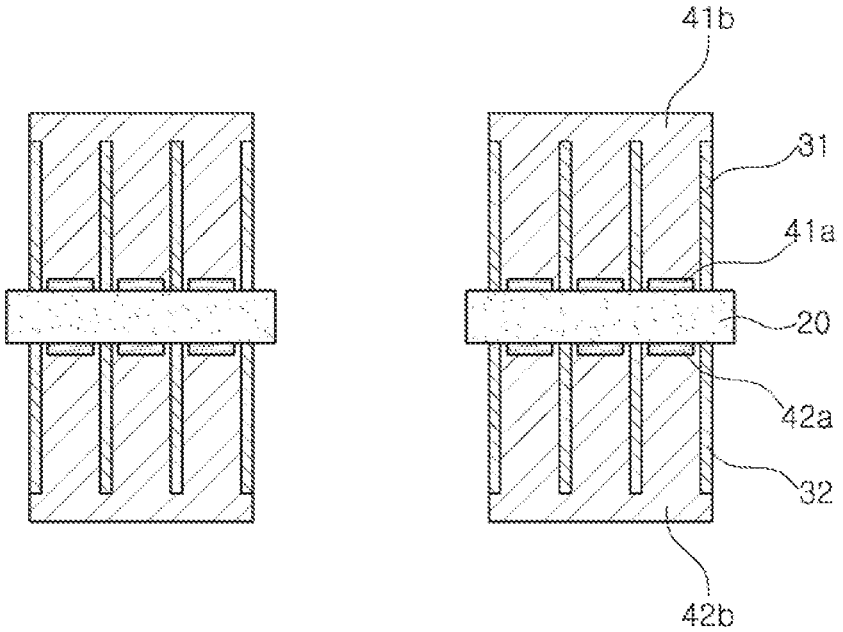

Next, referring to FIG. 3C, by forming plating portions 41*b* and 42*b* on the seed portions 41*a* and 42*a* by electroplating, coils 41 and 42 including the seed portions and the plating portions may be formed.

Figure 3D:
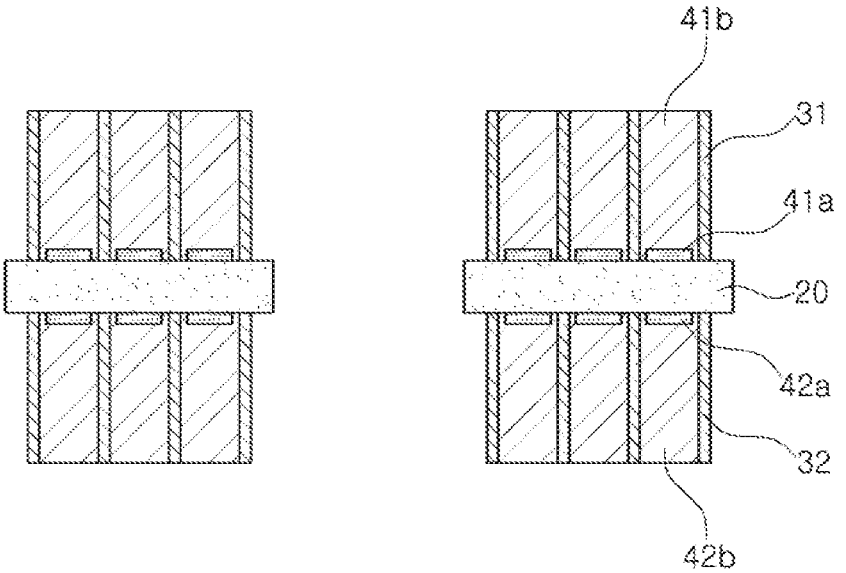

Next, referring to FIG. 3D, surfaces of the coils 41 and 42 are polished as needed, such that thicknesses of the coils 41 and 42 and thicknesses of the first insulators 31 and 32 may be matched to each other. As described above, this is to prevent an occurrence of the short circuit between the neighboring coils, or the decrease in capacity due to the decrease in the area of the magnetic material in advance.

Figure 3E:
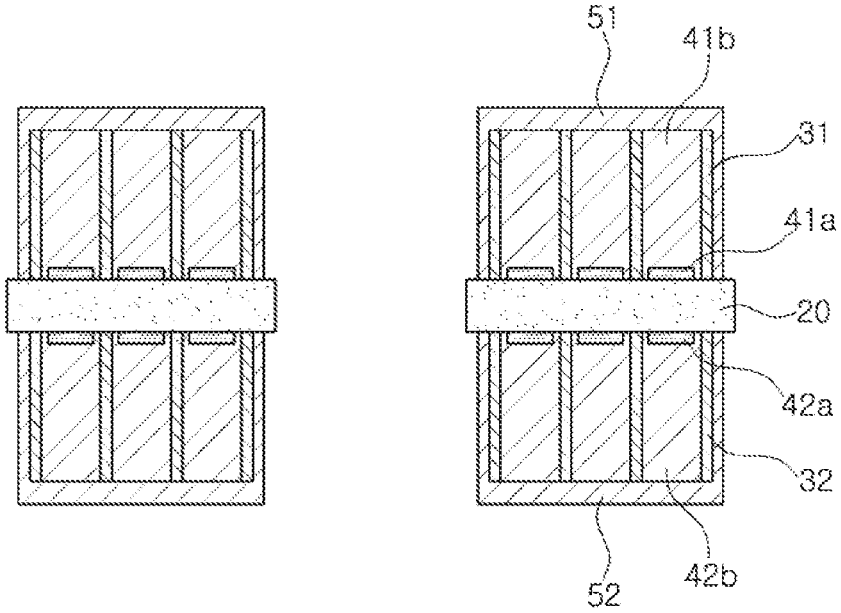

Next, referring to FIG. 3E, second insulators 51 and 52 covering top surfaces of the coils 41 and 42 may be formed, thereby finishing the manufacturing of the coil portions.

Thereafter, a body 60 in which the coil portions are embedded may be formed by stacking, compressing, and curing magnetic sheets on upper and lower portions of the coil portions.

The magnetic sheet may be manufactured in a sheet type by manufacturing a slurry by mixing a metallic magnetic powder with an organic material such as a thermosetting resin, a binder, a solvent, or the like, applying the slurry on a carrier film at a thickness of several tens μm by a doctor blade method, and then drying the applied slurry.

In addition, the external electrodes 81 and 82 may be formed of a paste containing a metal having excellent electrical conductivity, and the paste may be, for example, a conductive paste containing, one of nickel (Ni), copper (Cu), tin (Sn), and silver (Ag), or an alloy thereof. Further, a plating layer (not illustrated) may be further formed on the external electrodes 81 and 82. In this case, the plating layer may include any one or more selected from the group consisting of nickel (Ni), copper (Cu), and tin (Sn), and for example, a nickel (Ni) plating layer and a tin (Sn) plating layer may be sequentially formed.

Except for the above-mentioned description, a description of characteristics overlapping with those of the coil component 100 according to an exemplary embodiment described above will be omitted.

FIGS. 4A through 4E are views sequentially illustrating a process of manufacturing a coil component according to another exemplary embodiment in the present disclosure.

Figure 4A:
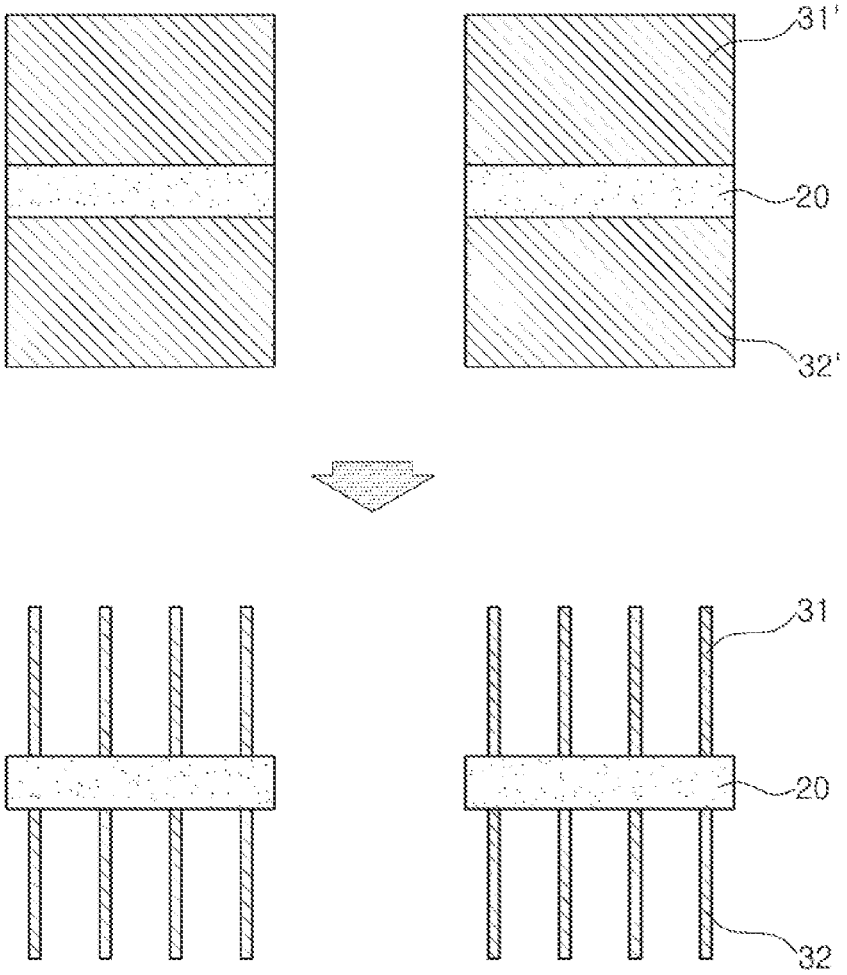
FIGS. 4A through 4E are views sequentially illustrating a process of manufacturing a coil component according to another exemplary embodiment in the present disclosure.

First, referring to FIG. 4A, the first insulators 31 and 32 having the opening of the planar coil shape may be formed on at least one of the first and second main surfaces of the support member 20.

In the present disclosure, a method for forming the first insulators 31 and 32 having the opening of the planar coil shape is not particularly limited. As a non-limiting exemplary embodiment, the first insulators 31 and 32 having the opening of the planar coil shape may be formed by forming insulating sheets 31' and 32' on the first and second main surfaces of the support member 20, respectively, forming photo resists having the opening of the planar coil shape on the insulating sheets 31' and 32', and then selectively removing the insulating sheets 31' and 32' by exposure and development.

Figure 4B:
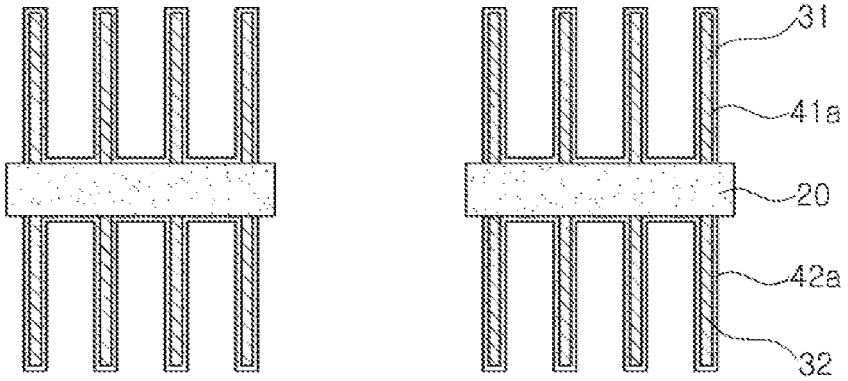

Next, referring to FIG. 4B, the seed portions 41*a* and 42*a* may be formed on bottom surfaces, top surfaces and side surfaces of the openings.

Figure 4C:
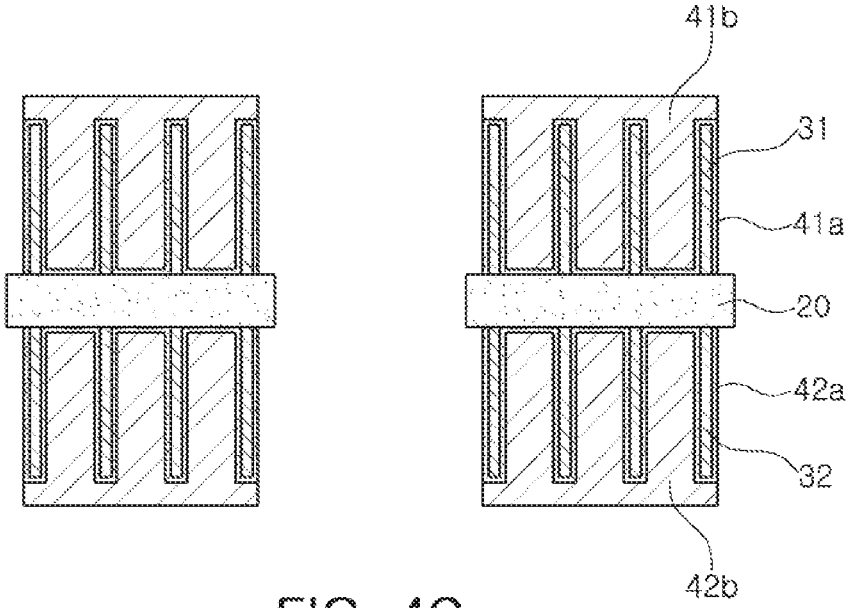

Next, referring to FIG. 4C, by forming the plating portions 41*b* and 42*b* on the seed portions 41*a* and 42*a* by electroplating, the coils 41 and 42 including the seed portions and the plating portions may be formed.

Figure 4D:
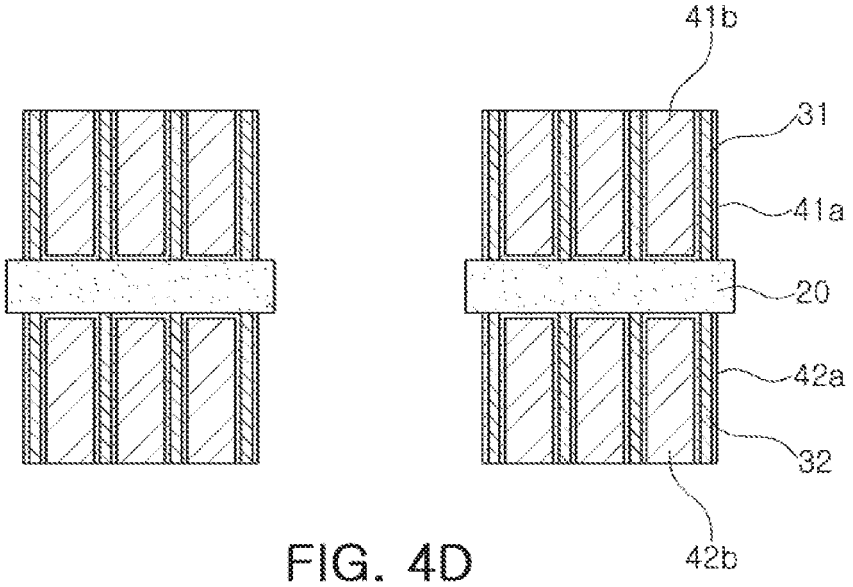

Next, referring to FIG. 4D, the surfaces of the coils 41 and 42 are polished as needed, such that the thicknesses of the coils 41 and 42 and the thicknesses of the first insulators 31 and 32 may be matched to each other.

Figure 4E:
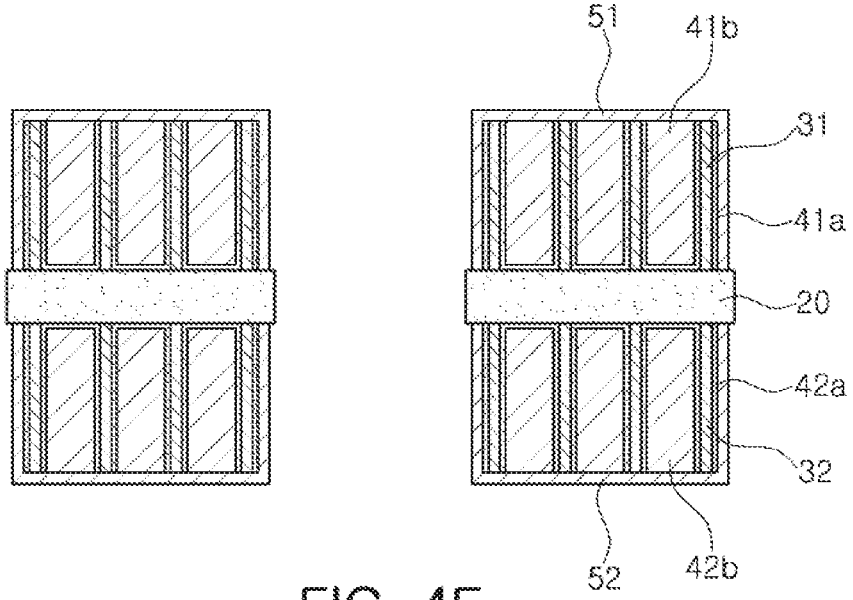

Next, referring to FIG. 4E, the second insulators 51 and 52 covering the top surfaces of the coils 41 and 42 may be formed, thereby finishing the manufacturing of the coil portions.

Except for the above-mentioned description, a description of characteristics overlapping with those of the method for manufacturing a coil component 100 according to the exemplary embodiment described above will be omitted.

As set forth above, according to the exemplary embodiments in the present disclosure, a coil having a high aspect ratio may be implemented, whereby a coil component having excellent product characteristics may be implemented.

While exemplary embodiments have been shown and described above, it will be apparent to those skilled in the art that modifications and variations could be made without departing from the scope of the present invention as defined by the appended claims.

What is claimed is:

1. A coil component comprising:

a body in which a coil portion is embedded, wherein the coil portion includes a support member;

first insulators formed on first and second main surfaces of the support member, respectively, and having an opening having a planar coil shape;

coils filling the opening; and second insulators covering the coils, wherein thicknesses of the first insulators and thicknesses of the coils are the same as each other, upper surfaces of the coils include central portions and peripheral portions, the peripheral portions being in direct contact with the first insulators, the central portions of the upper surfaces of the coils and the peripheral portions of the upper surfaces of the coils are substantially disposed on the same plane as upper surfaces of the first insulators, and wherein the coil includes a seed portion disposed on a surface of the support member arranged outward of an outermost portion of the first insulators.

2. The coil component of claim 1, wherein an aspect ratio of the coils is between 3:1 and 9:1.

3. The coil component of claim 1, wherein the coils further include a plating portion formed on the seed portion to fill the opening.

4. The coil component of claim 1, wherein the seed portion is formed on side surfaces of the first insulators, and the coils further include a plating portion formed on the seed portion to fill the opening.

5. The coil component of claim 1, wherein an aspect ratio of the first insulators is between 5:1 and 25:1.

6. The coil component of claim 1, wherein the first insulators are formed of a photosensitive material.

7. The coil component of claim 1, wherein the first insulators include a photo acid generator (PAG) and one or more epoxy based resins.

8. The coil component of claim 1, wherein the second insulators include one or more selected from the group consisting of an epoxy based resin, a polyimide based resin, and a liquid crystalline polymer (LCP) based resin.

9. The coil component of claim 1, wherein the coils formed on the first and second main surfaces of the support member, respectively, are electrically connected to each other by a via electrode penetrating through the support member.

10. The coil component of claim 1, wherein the support member is a polypropylene glycol (PPG) substrate, a ferrite substrate, or a metal soft magnetic substrate.

11. The coil component of claim 1, wherein the body includes a ferrite powder or metallic magnetic powder dispersed in an epoxy resin or a polyimide resin.

12. The coil component of claim 1, wherein the seed portion is disposed on another surface of the support member arranged inward of an innermost portion of the first insulators.

13. The coil component of claim 1, wherein the central portions of the upper surfaces of the coils and the peripheral portions of the upper surfaces of the coils are polished so as to be substantially disposed on the same plane as upper surfaces of the first insulators.

14. A coil component comprising:

a body in which a coil portion is embedded, wherein the coil portion includes a support member;

first insulators formed on first and second main surfaces of the support member, respectively, and having an opening having a planar coil shape;

coils filling the opening; and second insulators covering the cons, wherein thicknesses of the first insulators and thicknesses of the cons are the same as each other, upper surfaces of the coils include central portions and peripheral portions, the peripheral portions being in direct contact with the first insulators, the central portions of the upper surfaces of the coils and the peripheral portions of the upper surfaces of the coils are substantially disposed on the same plane as upper surfaces of the first insulators; and wherein the coil includes a seed portion disposed on the first insulators and on a surface of the support member arranged outward of an outermost portion of the first insulators or inward of an innermost portion of the first insulators.

* * * * *